United States Patent [19]

Schuller

[11] 4,371,122

[45] Feb. 1, 1983

[54] METHOD AND APPARATUS FOR WINDING STRAND MATERIAL AND PACKAGE

[75] Inventor: Marius C. Schuller, Guelph, Canada

[73] Assignee: Fiberglas Canada, Inc., Ontario, Canada

[21] Appl. No.: 147,729

[22] Filed: May 8, 1980

[30] Foreign Application Priority Data

Feb. 29, 1980 [CA] Canada ..... 346760

[51] Int. Cl.[3] ..... B65H 54/08; B65H 54/28; B65H 55/00

[52] U.S. Cl. ..... 242/43 R; 242/18 R; 242/18 G; 242/26; 242/178

[58] Field of Search ..... 242/43 R, 18 DD, 18 R, 242/18 G, 18.1, 26, 18 CS, 178, 174, 175, 176, 177

[56] References Cited

U.S. PATENT DOCUMENTS

| | | | |
|---|---|---|---|
| 1,994,404 | 3/1935 | Reiners et al. | 242/18 DD |
| 3,235,191 | 2/1966 | Engelman et al. | 242/18.1 |
| 3,315,904 | 4/1967 | Hardee | 242/43 R X |
| 3,402,898 | 9/1968 | Mattingly | 242/43 R |
| 3,491,960 | 1/1970 | Furst | 242/18 DD |
| 3,497,148 | 2/1970 | Heumann | 242/43 R |
| 3,547,361 | 12/1970 | Klink | 242/18 G |
| 3,589,631 | 6/1971 | Jennings et al. | 242/43 R X |
| 3,801,032 | 4/1974 | Sears et al. | 242/43 R |
| 4,203,559 | 5/1980 | Coggin, Jr. et al. | 242/18 CS X |

*Primary Examiner*—Stanley N. Gilreath

*Attorney, Agent, or Firm*—Birch, Stewart, Kolasch and Birch

[57] ABSTRACT

In a method and apparatus for winding strand material into a package on a mandrel rotated at a progressively decreasing speed, the strand material being guided adjacent the package build by a guide member reciprocated by a cam. The cam speed is repeatedly or continuously increased relative to that of the mandrel to counteract or even eliminate reduction of the helix angle at which the strand material is deposited on the package build.

18 Claims, 4 Drawing Figures

METHOD AND APPARATUS FOR WINDING STRAND MATERIAL AND PACKAGE

FIELD OF THE INVENTION

The present invention relates to methods and apparatus for winding strand material and is useful in particular, but not exclusively, for the winding of single strand or multistrand packages in which the or each strand is formed of a multiplicity of glass fibre filaments.

BACKGROUND OF THE INVENTION

In a well known prior art package winding apparatus, a strand guide, of the type sometimes referred to as a guide eye, is reciprocated by a traversing mechanism parallel to the axis of rotation of a winding mandrel. Strand material is guided by the guide onto the rotating winding mandrel so as to be helically wound into a package build on the mandrel.

The traversing mechanism comprises a cam having an endless helical cam groove and rotated about an axis parallel to that of the winding mandrel, and the guide member is secured to a cam follower engaging in the cam groove.

The cam is provided within a cylindrical housing extending from the lower end of a cam arm, which is pivotal in a cam arm pivot having an axis of pivotation parallel to the axes of the cam and the winding mandrel.

During the winding of the package, the diameter of the package build on the winding mandrel is sensed and the cam arm, and therewith the cam and the guide member, are pivoted in a stepped movement about the cam arm pivot axis.

Also, the speed of rotation of the winding mandrel is progressively reduced, during the winding of the package, so that the length of strand material drawn into the package build per unit of time, sometimes referred to as the yield, is maintained constant.

The rotational driving of the winding mandrel is effected through a drive transmission from a drive motor, and a cam drive transmission is provided between the winding mandrel drive transmission and the cam so that the cam is rotated in timed relation to the rotation of the winding mandrel.

As the winding of the package proceeds, and consequently the speed of rotation of the winding mandrel is reduced and the speed of rotation of the cam, and thus the speed of reciprocation of the guide member, are correspondingly reduced, the helix angle, i.e. the angle between the strand material wrap on the package build and a plane perpendicular to the winding mandrel axis, is progressively reduced.

This reduction of the helix angle occurs because the cam is rotated in timed relation to the reducing speed of rotation of the winding mandrel in order to maintain a constant waywind ratio, i.e. a constant number of strand wraps on the package build during each traverse of the guide member, and consequently the increasing diameter of the package build results in the strand wrap being deposited at a slightly but increasingly reduced helix angle.

Such reduction of the helix angle has various disadvantages.

For example, when the winding apparatus is employed for winding multistrand packages, for the production of multiple split slivers, the alteration of the helix angle adversely and progressively affects the spacing of the individual strands in the build.

Further, the reduction of the helix angle during the package formation limits the winding speed at which square edge packages can be produced and consequently prevents the winding of stable package builds at high speeds.

In both cases, the winding mandrel speed of rotation is limited both by the maximum speed at which the cam can reciprocate the guide member or guide eye without failure of its component parts and also by the necessity for maintaining a minimum helix angle to ensure stable package builds and/or, in the case of multistrand winding, adequate spacing of the strands in the package build.

OBJECTS OF THE INVENTION

It is accordingly an object of the present invention to provide a novel and improved winding apparatus having a cam traversing mechanism which can operate at higher winding speeds than has been possible hitherto.

It is a further object of the present invention to improve the precision at which multistrand packages can be wound.

It is a still further object of the present invention to counteract reduction of the helix angle at which strand material is wound into a package build as the package build diameter increases.

SUMMARY OF THE INVENTION

According to the present invention, there is provided apparatus for winding strand material into a package, comprising a winding mandrel; means for rotationally driving the winding mandrel; means for guiding the strand material in the vicinity of the mandrel; cam means for reciprocating the guide means parallel to the axis of the winding mandrel for forming a package build on the winding mandrel; means for moving the strand guide means and the cam means away from the winding mandrel as the diameter of the package build increases; and the mandrel drive means including mandrel speed control means for progressively reducing the speed of rotation of the winding mandrel during the winding of the package to compensate for increases in the diameter of the package build; and means for rotationally driving the cam means; the cam drive means comprising means for increasing the speed of rotation of the cam means relative to that of the winding mandrel, and thereby counteracting reduction of the helix angle at which the strand material is wound on the package build, as the winding mandrel speed decreases.

BRIEF DESCRIPTION OF THE DRAWINGS

The invention will be more readily understood from the following description of preferred embodiments thereof given, by way of example, with reference to the accompanying drawings, in which.

DESCRIPTION OF PREFERRED EMBODIMENTS

Figures 1, 2:
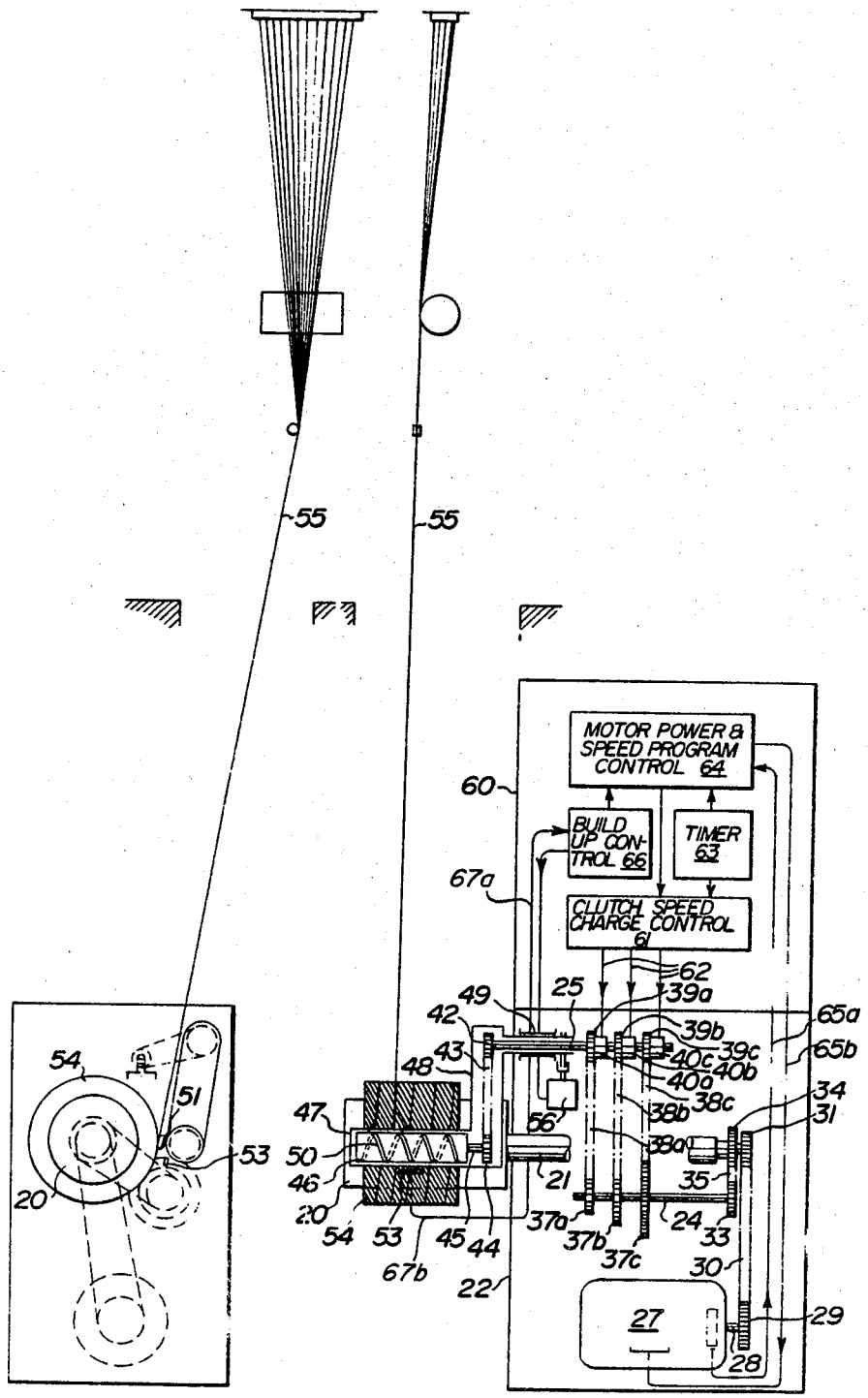
FIG. 1 shows a view in side elevation of a strand material winding apparatus embodying the present invention.
FIG. 2 shows a front view in elevation of the strand material winding apparatus of FIG. 1 and its associated control apparatus.

In FIGS. 1 and 2, reference numeral 20 indicates a winding mandrel, which is mounted at one end of a winding mandrel or collet drive shaft 21, which is journalled within a housing 22.

An intermediate cam drive shaft 24 and a cam drive shaft 25 are also journalled within the housing 22 and extend parallel to the mandrel drive shaft 21.

An electric drive motor 27 has an output shaft 28 provided with a pulley 29, which drives an endless belt 30 extending around a pulley 31 on the mandrel drive shaft 21, so that the mandrel 20 is rotationally driven by the electric drive motor 27.

The intermediate cam drive shaft 24 is also driven from the electric drive motor 27 through a power take-off comprising a pair of pulleys 33 and 34, which are fixed to the intermediate cam drive shaft 24 and the mandrel drive shaft 21, respectively, and an endless drive belt 35 extending around the pulleys 33 and 34. The transmission ratio of the timing pulleys 33 and 34 is determined by the yield required and can be varied by replacement of the pulleys 33 and 34 by a different pair of pulleys having a different transmission ratio.

The intermediate cam drive shaft 24 has fixedly mounted thereon three drive pulleys 37*a*, 37*b* and 37*c* of different diameters.

The drive pulleys 37*a*, 37*b* and 37*c* are drivingly connected by endless belts 38*a*, 38*b* and 38*c* to pulleys 39*a*, 39*b* and 39*c*, respectively, which in turn are provided with respective electromechanical clutches 40*a*, 40*b* and 40*c*. The pulleys 39*a*, 39*b* and 39*c* and their electromechanical clutches 40*a*, 40*b* and 40*c* are mounted on the cam drive shaft 25, and the pulleys 39*a*, 39*b* and 39*c* are freely rotatable relative to the cam drive shaft 25 until their respective electromechanical clutches 40*a*, 40*b* and 40*c* are energized.

When one of the electromechanical clutches 40*a*, 40*b* and 40*c* is energized, drive is transmitted from the intermediate cam drive shaft 24 to the cam drive shaft 25.

This drive is then transmitted through a pulley 42 on the cam drive shaft 25, an endless belt 43 and a pulley 44 to a cam shaft 45, on which the pulley 44 is mounted.

The cam shaft 45 is connected to a traversing cam 46, which is rotatably mounted within a cylindrical housing 47.

The cylindrical housing 47 projects laterally from a downwardly extending hollow arm 48 containing the pulleys 42 and 44 and the drive belt 43, and the arm 48 is pivotally mounted in a cam arm pivot 49 in the housing 22, the cam arm pivot 49 being co-axial with the cam drive shaft 25.

Consequently, the arm 48, and therewith the cam 46 and its housing 47, are pivotable about the cam drive shaft 25.

The cam 46 is provided with an endless helical cam groove 50 which engages a cam follower (not shown), on which is mounted a strand guide member or guide eye 51, so that the strand guide member 51 is reciprocated along the exterior of the housing 47, parallel to the axis of rotation of the winding mandrel 20, on rotation of the cam 46.

A package build up sensor 53 mounted at the underside of the cam housing 47 senses the periphery of a package build 54, formed by winding strand material 55 onto the winding mandrel 20 as described hereinafter, and the package build up sensor 53 initiates pivotation of the cam housing 47 away from the axis of the winding mandrel 20, in response to increases in the diameter of the package build 54, by operation of a package build compensator motor 56, which, when energized, causes rotation of the arm 48 about the cam drive shaft 25.

As will be apparent to those skilled in the art, the winding apparatus as hitherto described, and with the exception of the pulleys 37*a*–37*c* and 39*a*–39*c*, the endless drive belts 38*a*–38*c* and the electromagnetic clutches 40*a*–40*c*, is of known construction. However, instead of employing a single drive belt and a pair of pulleys fixed to the intermediate drive shaft and the cam drive shaft, respectively, as in known winding apparatus, the present apparatus, by employing a plurality of pulleys and drive belts and electromagnetic clutches for controlling the fixing of any one of the pulleys 39*a*–39*c* to the cam drive shaft, enables the transmission ratio of the power take-off or cam drive transmission between the mandrel drive shaft 21 and the cam drive shaft 25 to be varied.

The purpose of such variation will be described in detail hereinafter.

For controlling the operation of the above-described mechanism, the winding apparatus is provided with a winder control panel indicated generally by reference numeral 60.

The panel 60 has a clutch control unit 61, connected by three conductors 62 to respective ones of the electromagnetic clutches 40*a*, 40*b* and 40*c*, a timer 63 having an output connected to the clutch control unit 61 and a motor power and speed program control unit 64 connected to the drive motor 27 by conductors 65*a* and 65*b* and to the timer 63 and a build up control unit 66, the output of the control unit 64 being connected to the clutch control unit 61.

The build up control unit 66 is connected by conductors 67*a* and 67*b* to the build up sensor 53.

The operation of the above-described winding apparatus will now be described with reference to FIGS. 1 to 3.

Figure 3:
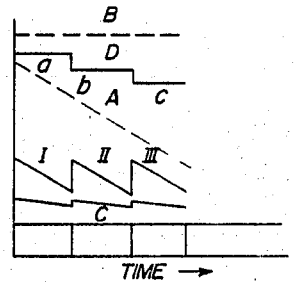
FIG. 3 shows a graph for use in understanding the operation of the winding apparatus of FIGS. 1 and 2.

At the beginning of the winding of the package, the mandrel speed, as indicated by the line A in FIG. 3, and which is controlled by the control unit 64, is at a maximum, and this speed decreases constantly throughout the winding of the package.

The purpose of this decrease of the mandrel speed of rotation is, as will be readily apparent to those skilled in the art, to ensure that the strand material 55 is drawn at a uniform rate or yield into the package build, as indicated by the line B in FIG. 3.

The cam drive shaft 25 is initially driven by the endless drive belt 38*a* from the pulley 37*a*, the electromagnetic clutch 40*a* being energized to connect the pulley 39*a* to the cam drive shaft 25 and the electromechanical clutches 40*b* and 40*c* being de-energized, so that the pulleys 39*b* and 39*c* rotate relative to the cam drive shaft 25 and transmit no drive to the latter.

As the mandrel speed of rotation decreases, in accordance with a reduction of the speed of the drive motor 27 under the control of the control unit 64, the speed of rotation of the cam 46 correspondingly decreases, as indicated by I in FIG. 3.

When one-third of the time required to wind a complete package has elapsed, the clutch control unit 61 is operated by the control unit 64 in response to a signal from the timer 63, or the corresponding lower speed of the drive motor 27, and through the conductors 62 the clutch control unit 61 de-energizes the electromechanical clutch 40*a* and simultaneously energizes the electromechanical clutch 40*b*.

The cam drive shaft 25 is now driven from the pulley 37*b* on the intermediate cam drive shaft and, since the diameter of the pulley 37*b* is larger than that of the pulley 37*a*, the speed of rotation of the cam 46 is increased.

More particularly, as indicated by II in FIG. 3, the speed of rotation of the cam 46 is restored to its magnitude at the beginning of the winding of the package.

However, the cam speed again begins to decrease, in response to the decrease in the speed of the mandrel 20 and the drive motor 27, until the second third of the time required for winding the complete package has elapsed, whereupon in the electromagnetic clutch 40*b* is de-energized and the electromagnetic clutch 40*c* is energized.

Since the pulley 37*c* has a larger diameter than the pulley 37*b*, the cam speed is then again restored to its initial magnitude, as indicated by III in FIG. 3, and again progressively decreases until the end of the winding of the package.

The line C in FIG. 3 represents the helix angle, and as will be apparent from that Figure, the helix angle decreases gradually, for the reasons explained above, as the cam speed decreases. However, when the cam speed is restored, as also explained above, the helix angle is likewise restored to its initial value. Thus, reductions of the helix angle as the package diameter increases are counteracted by the periodic restoration of the cam speed.

Line D in FIG. 3 represents the waywind ratio, and a, b and c represent, respectively, the periods of energization of the electromechanical clutches 40*a*, 40*b* and 40*c*.

While the above-described embodiment of the invention employs three pairs of pulleys 39*a*–39*c*, 40*a*–40*c*, it will be apparent to those skilled in the art that a larger number of pulleys and consequently a larger number of restorations of the cam speed and helical angle, may be employed.

Figure 4:
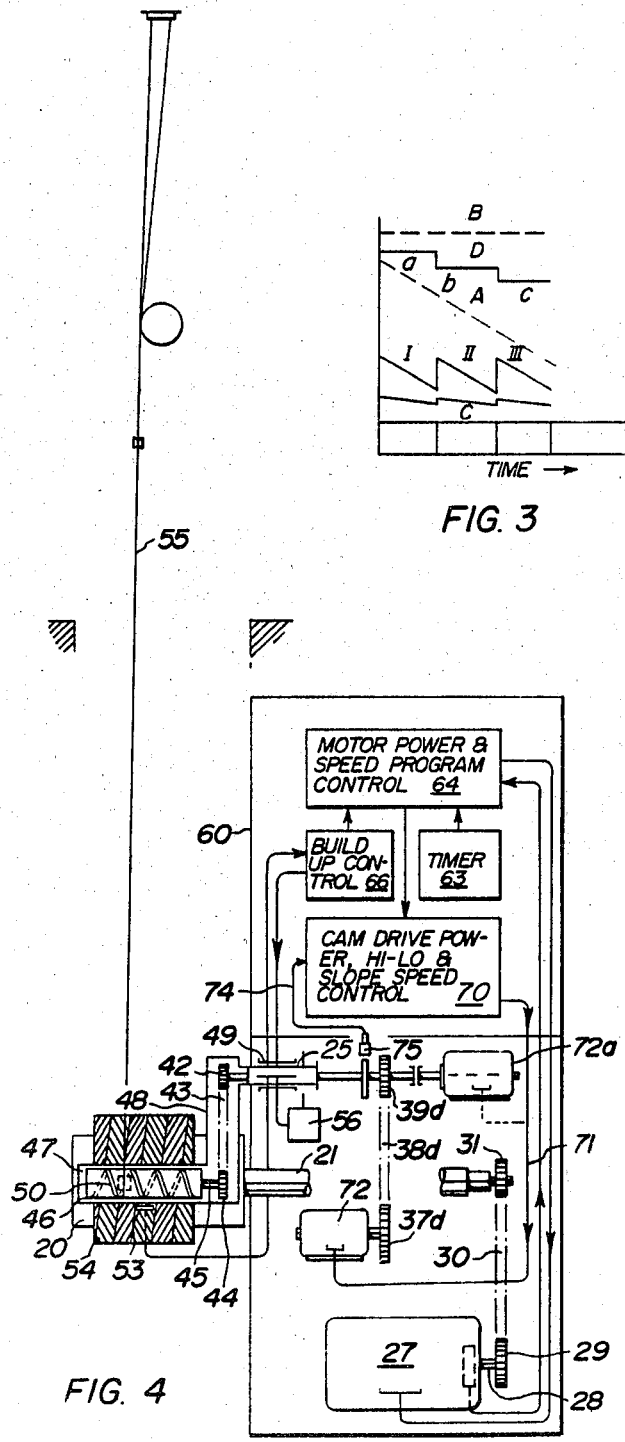
FIG. 4 shows a view corresponding to FIG. 2 but of a modified embodiment of the invention.

For convenience, parts of the winding apparatus illustrated in FIG. 4 which are similar to those of FIGS. 1 and 2 are indicated by the same reference numerals and accordingly will not again be described.

However, it will be immediately apparent that in the embodiment illustrated in FIG. 4, the three pairs of pulleys 37*a* to 37*c* and 39*a* to 39*c* and the three electromagnets 40*a* to 40*c* have been omitted and replaced by a single pair of pulleys 37*d* and 39*d*, connected by an endless belt 38*d*. Also, the clutch speed change control 61 is replaced by a cam drive speed control unit 70, which through conductor 71 controls the speed of rotation of a variable speed cam drive motor 72, which drives the pulley 37*d*.

The cam drive speed control unit 70 is connected by a conductor 74 to a tachometer 75 for detecting the speed of rotation of the cam drive shaft 25.

Instead of employing the electric motor 72 to drive the cam drive shaft 25 through the pulleys 37*d* and 39*d* and the belt 38*d*, these components may be replaced by a variable speed cam drive motor 72*a*, shown in full lines, coupled directly to the cam drive shaft 25.

The operation of the embodiment of the invention illustrated in FIG. 4 is similar to that of FIGS. 1 and 2 except that, instead of employing a plurality of electromagnetic clutches in succession for periodically increasing the speed of rotation of the cam drive shaft 25, the variable speed motor 72 or 72*a* is employed for that purpose.

More particularly, under the control of the control unit 64, the cam drive speed control unit 70 reduces the speed of rotation of cam drive shaft 25 in accordance with the decrease of rotational speed of winding mandrel 20. This is typically accomplished by programming control unit 70 to downwardly slope the rotational speed of motor 72 or 72*a* at a predetermined rate. To effect restorative increases in the cam speed, control unit 70 may be programmed to periodically, at least partially, restore the speed of rotation of cam 46 to its magnitude at the beginning of the winding of the package or a sensor, such as tachometer 75, may be utilized for causing control unit 70 to initiate a restorative increase in the speed of motor 72 or 72*a* and thus of the cam drive shaft 25 so that the helix angle is restored at least partially to its initial value at each cam speed increase.

It is possible, in some cases, to control the cam drive motor speed continuously, or substantially continuously, so as to maintain a cam speed and thus the helix angle constant, or at least substantially constant. If this is done, there is a possibility that the way wind ratio may pass through harmonics, i.e. every strand of every full way wind would be deposited on top of every preceding winding, thus producing an unacceptable package build. This can be avoided, in practice, by appropriate selection of the cam speed.

As mentioned hereinbefore, in conventional prior art winding apparatuses, the winding mandrel speed is limited both by the maximum speed of which the cam can reciprocate the guide member or guide eye and also in order to maintain a minimum helix angle during the winding of the final layers of the package.

With the above-described embodiments of the present invention, however, since the helix angle can be repeatedly restored, the winding operation can be initiated with a lower helix angle than would otherwise be possible. Consequently, the strand material can be drawn into the package at a higher rate.

Also, the cam speed is higher at the end of the winding operation than is possible with the conventional prior art winding apparatuses.

In addition, the restoration of the helix angle provides a more dense package than has been obtainable hitherto.

Thus, as will be apparent to those skilled in the art, the present invention offers a number of advantages over prior art package winding apparatuses and methods and, more particularly, the repeated restoration of the helix angle, or even the maintenance of the helix angle at a constant or substantially constant value, provides a build package having a more uniform density and less tex variability than has been possible hitherto, since the true wrap is constant.

By enabling a wide range of cam speed, way wind ratio and helix angle variation, the package build can be optimized.

Furthermore, the present invention offers a number of advantages when combined with the multistrand winding method and apparatus disclosed in co-pending U.S. patent application Ser. No. 114,394 filed Jan. 22, 1980, and the corresponding Canadian Pat. No. 1,108,576, issued on Sept. 8, 1981, the disclosures of which are incorporated herein by reference.

For example, the constant helix angle, or the limited helix angle variation, provided by the present invention allows simplification of the guide eye described in the above-mentioned co-pending application, since the deposition width of the split array of multiple strands does not have to be offset by diverging the guide elements of the guide eye in a V configuration.

The invention further enables packages of larger diameter than previously feasible to be produced and, in addition, makes it possible to rotate the cam at lower speeds than previously required, which affords the important advantage of reduced cam wear and consequentially greater cam life.

I claim:

1. Apparatus for winding strand material into a package, comprising:

a winding mandrel;

means for rotationally driving said winding mandrel;

means for guiding said strand material in the vicinity of said mandrel;

cam means for reciprocating said guide means parallel to the axis of said winding mandrel for forming a package build of said winding mandrel;

means for moving the strand guide means and said cam means away from said winding mandrel as the diameter of said package build increases;

said mandrel drive means including mandrel speed control means for progressively reducing the speed of rotation of said winding mandrel during the winding of said package to compensate for increases in the diameter of the package build; and means for rotationally driving said cam means in synchronous relation to the decreasing speed of said winding mandrel whereby the speed of rotation of said cam means decreases in accordance with the mandrel speed reduction;

said cam drive means comprising means for increasing the rotational speed of said cam means a plurality of times during the winding of said strand material on said package build to counteract reduction of the helix angle at which the strand material is wound on the package build as the winding mandrel speed decreases.

2. Apparatus as claimed in claim 1, wherein said cam speed increasing means comprise means for restoring the speed of rotation of said cam means at said plurality of times during the winding of the package to an initial speed at which said cam rotates at the beginning of the winding of the package.

3. Apparatus as claimed in claim 2, wherein said speed restoring means comprises means for sensing the package build diameter and control means responsive to said sensing means for initiating increases in the speed of rotation of said cam means.

4. Apparatus as claimed in claim 2, wherein said speed restoring means comprise means for timing the winding of the package and control means responsive to said timing means for initiating increases in the speed of rotation of said means.

5. Apparatus as claimed in claim 1, wherein said cam speed increasing means comprise a variable ratio drive transmission means for drivingly connecting said winding mandrel drive means to said cam means for varying the transmission ratio of said drive transmission means.

6. Apparatus as claimed in claim 5, wherein said drive transmission means comprise a first shaft, means for rotating said first shaft, a second shaft parallel to said first shaft, means for connecting said second shaft to said cam means, a plurality of clutch means on one of said first and second shafts, and means for drivingly connecting said clutch means to the other of said first and second shafts with different transmission ratios, and said ratio varying means comprising control means for operating one of said clutch means at a time to drivingly connect said first and second shafts at a respective one of said transmission ratios.

7. Apparatus as claimed in claim 1, wherein said cam drive means comprise a variable speed prime mover separate from said winding mandrel drive means and said cam speed increasing means comprise means for sensing the speed of rotation of said cam means and control means responsive to said sensing means for initiating increases in the speed of rotation of said cam means at said plurality of times during the winding of said strand material.

8. Apparatus for winding strand material into a package, comprising:

a winding mandrel;

means for guiding said strand material in the vicinity of said mandrel;

cam means for reciprocating said guide means parallel to the axis of said winding mandrel for forming a helically wound package build on said mandrel;

means for moving said strand guide means and said cam means away from said mandrel as the diameter of said mandrel as the diameter of said package build increases;

said mandrel drive means including mandrel speed control means for progressively reducing the speed of rotation of said winding mandrel during the winding of said package to compensate for increases in the diameter of the package build;

drive transmission means interconnecting said cam means and said mandrel drive means for driving the former from the latter, whereby the speed of rotation of said cam means decreases in accordance with the mandrel speed reduction;

means for varying the transmission ratio of said drive transmission means; and control means for operating said transmission ratio varying means to restore the cam means rotational speed a plurality of times during the package winding to counteract reduction of the helix angle at which the strand material is wound on the package build.

9. A method of winding strand material into a package, comprising the steps of:

rotating a winding mandrel;

guiding the strand material onto said winding mandrel at a guidance position in the vicinity of said winding mandrel;

reciprocating the guidance position parallel to the axis of rotation of said winding mandrel at a reciprocation speed in timed relation to the rotation of said winding mandrel to form the strand material into a helically wound package build on said winding mandrel;

moving the guidance position away from the winding mandrel axis as the diameter of the package build increases;

progressively reducing the speed of rotation of said winding mandrel during the winding of the package to compensate for increases in the package build diameter;

reducing the speed of the reciprocation of the guidance position in response to the reduction of the speed of rotation of said winding mandrel; and increasing the speed of reciprocation of said guidance position relative to the speed of rotation of said winding mandrel to counteract reduction of the helix angle at which the strand material is wound on the package build, as the winding mandrel speed decreases.

10. A method as claimed in claim 9, in which the step of increasing the speed of reciprocation of said guidance position relative to the speed of rotation of said winding mandrel comprises at least partially restoring the speed of reciprocation of said guidance position, at a plurality of time intervals during the winding of the package, to an initial speed at which said guidance position reciprocates at the beginning of the winding of the package.

11. A method as claimed in claim 10, which includes sensing increases in the diameter of the package build during the winding of the package and initiating the restoration of the reciprocation speed each time the sensor package build diameter increases by a predetermined amount.

12. A method as claimed in claim 9, which includes initiating the increase of the reciprocation speed of said guidance position at predetermined periods of time following the beginning of the winding of the package.

13. A method as claimed in claim 9, which includes rotating said winding mandrel and reciprocating said guidance position by power from a common drive motor and varying the transmission ratio between the common drive motor and the guidance position for effecting the relative speed increase.

14. A method as claimed in claim 9, which includes employing separate first and second prime movers to reciprocate said guidance position and to rotate said winding mandrel, respectively; sensing the speed of reciprocation of said guide position, and variably controlling the speed of said first prime mover to effect the speed increase of said guidance position.

15. In a strand material package comprising a multiplicity of successive layers of helically wound strand material having a helix angle which decreases from an initial value at an initial innermost one of said layers, the improvement comprising a plurality of successive sudden increases in the helix angle of said strand material between said innermost layer and an outermost one of said layers, said strand material having a way wind ratio which is constant between said helix angle increases and which decreases at each of said helix angle increases.

16. A strand material package as claimed in claim 15, wherein the helix angle of said strand material immediately following each of said increases is equal to said initial value.

17. Apparatus for winding strand material into a package, comprising:

a winding mandrel;

means for rotationally driving said winding mandrel;

means for guiding said strand material in the vicinity of said mandrel;

cam means for reciprocating said guide means parallel to the axis of said winding mandrel for forming a package build on said winding mandrel;

means for moving the strand guide means and said cam means away from said winding mandrel as the diameter of said package build increases;

said mandrel drive means including mandrel speed control means for progressively reducing the speed of rotation of said winding mandrel during the winding of said package to compensate for increases in the diameter of the package build; and means for rotationally driving said cam means in synchronous relation to the decreasing speed of said winding mandrel whereby the speed of rotation of said cam means decreases in accordance with the mandrel speed reduction;

said cam drive means comprising means for increasing the speed of rotation of said cam means a plurality of times during the package winding to counteract reduction of the helix angle at which the strand material is wound on the package build as the winding mandrel speed decreases, said cam speed increasing means comprising means for at least partially restoring the speed of rotation of said cam means at said plurality of times during the winding of the package to an initial speed at which said cam rotates at the beginning of the winding of the package, said cam speed restoring means including means for sensing the package build diameter and control means responsive to said sensing means for initiating increases in the speed of rotation of said cam means.

18. Apparatus for winding strand material into a package, comprising:

a winding mandrel;

means for rotationally driving said winding mandrel;

means for guiding said strand material in the vicinity of said mandrel;

cam means for reciprocating said guide means parallel to the axis of said winding mandrel for forming a package build on said winding mandrel;

means for moving the strand guide means and said cam means away from said winding mandrel as the diameter of said package build increases;

said mandrel drive means including mandrel speed control means for progressively reducing the speed of rotation of said winding mandrel during the winding of said package to compensate for increases in the diameter of the package build; and means for rotationally driving said cam means in synchronous relation to the decreasing speed of said winding mandrel whereby the speed of rotation of said cam means decreases in accordance with the mandrel speed reduction;

said cam drive means comprising means for increasing the speed of rotation of said cam means a plurality of times during the package winding to counteract reduction of the helix angle at which the strand material is wound on the package build as the winding mandrel speed decreases, said cam speed increasing means comprising means for at least partially restoring the speed of rotation of said cam means at said plurality of times during the winding of the package to an initial speed at which said cam rotates at the beginning of the winding of the package, said cam speed restoring means comprising means for timing the winding of the package, and control means responsive to the timing means for initiating increases in the speed of rotation of said cam means.

* * * * *